United States Patent [19]

Schwartz

[11] 4,415,957

[45] Nov. 15, 1983

[54] PATIENT LIGHT WITH HANGER AND HINGE ARRANGEMENT FOR REMOVAL WITHOUT TOOLS

[75] Inventor: Wesley W. Schwartz, Oshkosh, Wis.

[73] Assignee: Square D Company, Palatine, Ill.

[21] Appl. No.: 234,075

[22] Filed: Feb. 13, 1981

[51] Int. Cl.[3] ..... F21V 21/08

[52] U.S. Cl. ..... 362/297; 362/147; 362/217; 362/226; 362/374; 362/375; 362/310

[58] Field of Search ..... 362/145, 147, 226, 306, 362/217, 225, 297, 374, 375, 390, 310

[56] References Cited

U.S. PATENT DOCUMENTS

| | | | |
|---|---|---|---|
| 3,185,835 | 5/1965 | Müller et al. | 362/225 X |
| 3,686,496 | 8/1972 | Totten et al. | 362/217 X |
| 3,867,621 | 2/1975 | Gewfrtz et al. | 362/147 X |
| 4,104,710 | 8/1978 | Damico et al. | 362/147 X |
| 4,129,900 | 12/1978 | Sanz | 362/226 X |
| 4,157,584 | 6/1979 | Bhatt | 362/147 X |
| 4,158,221 | 6/1979 | Agabekov | 362/226 X |
| 4,164,009 | 8/1979 | Maguire, Jr. et al. | 362/226 X |
| 4,323,955 | 4/1982 | Mark | 362/225 X |
| 4,356,537 | 10/1982 | Stahlhut et al. | 362/365 X |

FOREIGN PATENT DOCUMENTS

| | | | |
|---|---|---|---|
| 2802317 | 7/1979 | Fed. Rep. of Germany | 362/226 |
| 3021850 | 6/1980 | Fed. Rep. of Germany | 362/374 |

*Primary Examiner*—Peter A. Nelson

*Attorney, Agent, or Firm*—John R. Garrett; Stephen A. Litchfield; Richard T. Guttman

[57] ABSTRACT

This disclosure depicts a novel light fixture having a base, a support section and a cover with means for connecting electrical components on the base with electrical lighting components on the support section. The support section and cover can be assembled and disassembled from the base without the use of any tools.

16 Claims, 10 Drawing Figures

PATIENT LIGHT WITH HANGER AND HINGE ARRANGEMENT FOR REMOVAL WITHOUT TOOLS

BACKGROUND OF THE INVENTION

The present invention relates generally to lighting fixtures and more particularly to lighting fixtures which may be assembled and disassembled without the use of tools. Typically, lighting fixtures are held together with screws, bolts or other fastening items which require the use of tools when the fixture must be disassembled for repair. This may pose a problem in such environments as hospitals where it can be disturbing to the patients if a significant amount of time is required to take a lighting fixture apart for repair in the room. The present invention has many applications but is believed to be most advantageously associated with a lighting fixture used in a hospital over a patient's bed.

OBJECTS OF THE INVENTION

It is a general object of the present invention to provide an improved lighting fixture.

It is a more specific object of the present invention to provide an improved lighting fixture having the capability of being assembled and disassembled without the use of any tools.

It is a further object to provide a lighting fixture in which interchangeable parts may be utilized for ease in servicing the fixture.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

DESCRIPTION OF THE PREFERRED EMBODIMENT

Whereas the invention may be implemented in lighting fixtures of various types, it is preferably embodied in a lighting fixture of the nature shown in FIGS. 1A to 1D. The novel invention permits the assembly and disassembly of the light fixture without the use of any tools. This permits quick and fast service within a hospital room where the light fixture may be used. The portion of the light fixture which needs repair may be taken to another location and an identical new section can be placed immediately in the light fixture in the room.

Thus the novel light fixture minimizes disturbance when repair is needed within the hospital room.

The present invention will now be described. In general terms, the novel light fixture has electrical lighting components and comprises a base with electrical components for attachment to a source of electrical power. The base has top and bottom outer attachment means and top and bottom inner attachment means. The light fixture further comprises a support section for supporting the electrical lighting components. support section has top and bottom attachment means for interlocking with the top and bottom inner attachment means of the base. The light fixture also comprises a cover with light emitting portions having top and bottom attachment means for interlocking with the top and bottom outer attachment means of the base. The light fixture further comprises means for electrically connecting the electrical components of the base to the electrical lighting components of the support section. The support section and the cover can be assembled and disassembled from the base without the use of any tools. The support section can be held in place on the base in two different positions. The bottom attachment means on the base and the bottom attachment means on the support section are capable of interlocking in two different positions.

Figure 1A:
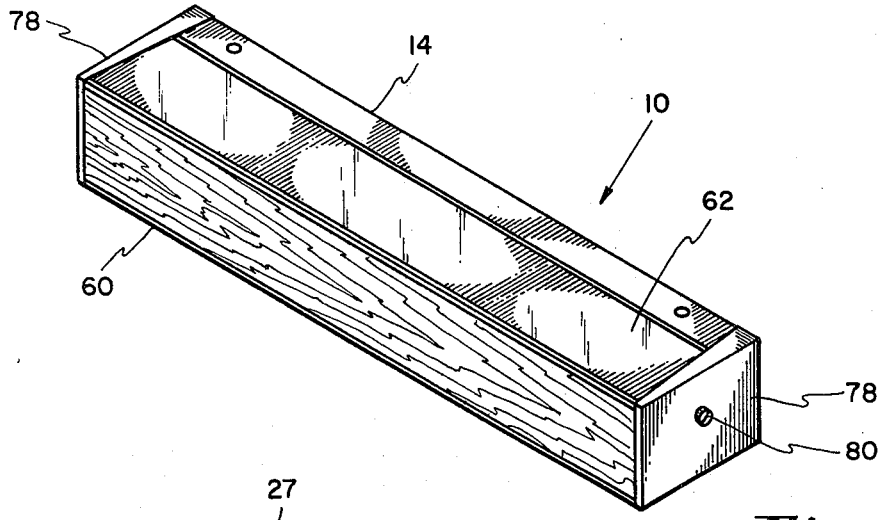
FIGS. 1A to 1D are perspective views of the novel lighting fixture in various stages of disassembly.
Figure 1B:
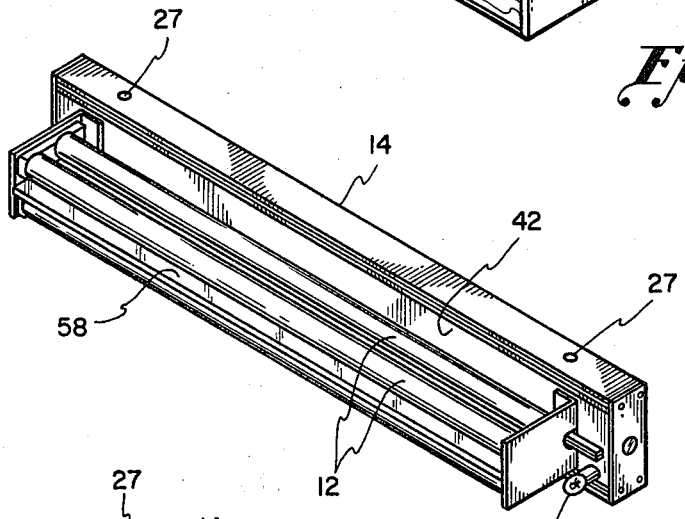
Figure 1C:
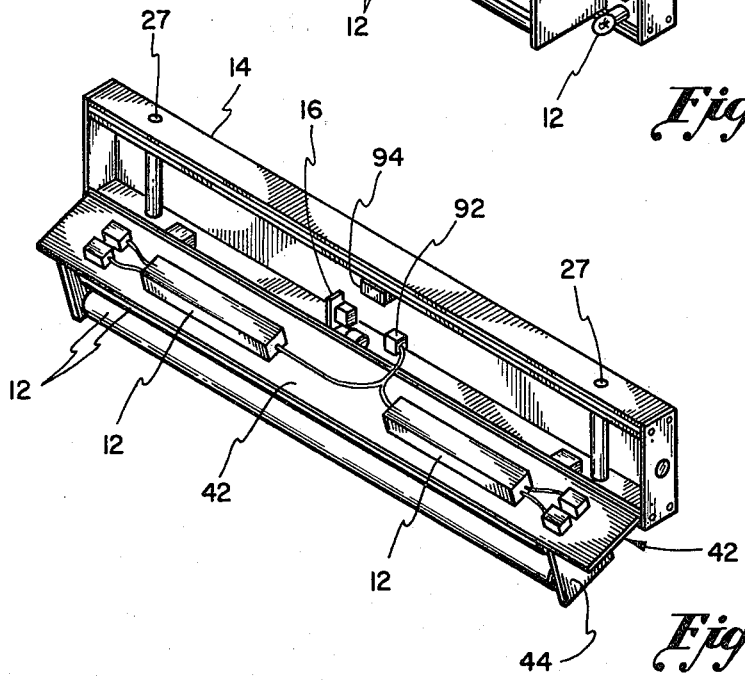
Figure 1D:
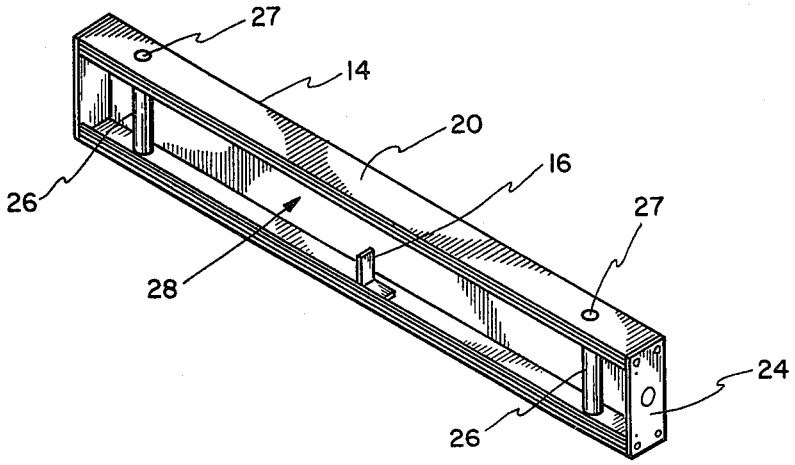
Figure 3:
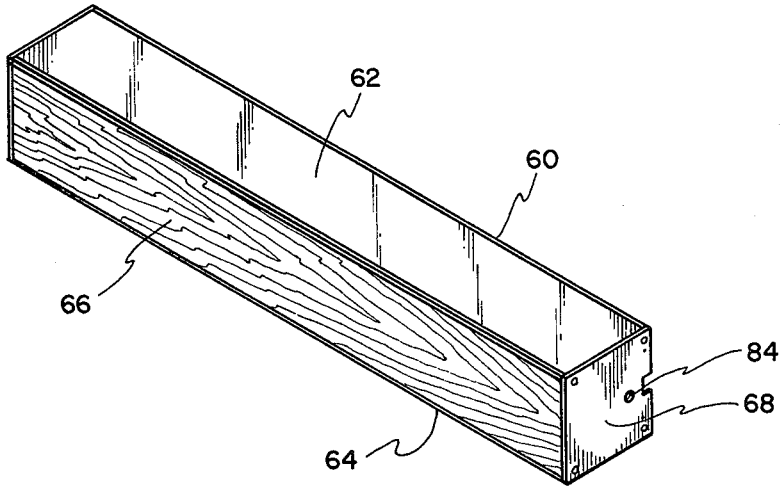
FIG. 3 is a perspective view of a cover for the lighting fixture.
Figure 4:
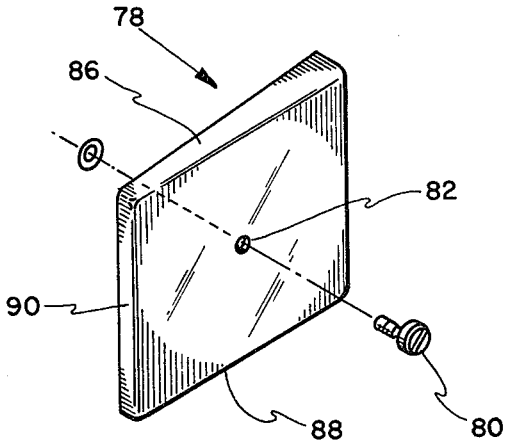
FIG. 4 is perspective view of an end plate for the lighting fixture.

A preferred embodiment of the present invention is illustrated in FIGS. 1A to 1D, 2, 3, 4, and 5. FIG. 1A shows a perspective view of the novel light fixture 10 as completely assembled. FIGS. 1B to 1D show the novel light fixture 10 in various stages of disassembly. The light fixture 10 has electrical lighting components 12 which in the preferred embodiment include lamps, brackets for holding the lamps and ballasts for powering the lamps. The light fixture 10 comprises a substantially rectangular box like base 14 with eletrical components 16 for attachment to a source of electrical power. The base has a back wall 18, a top and bottom wall 20 and 22, and two end walls 24. The base 14 also has two internal end support posts 26 each located near an end of the base 14. The end support posts 26 are hollow tubes with corresponding openings 27 in the top wall 20 of the base 14 for supporting the rod of an examiner light or for an IV rod. The base 14 also has a front opening 28 formed by the box like structure of the base 14.

Figure 2:
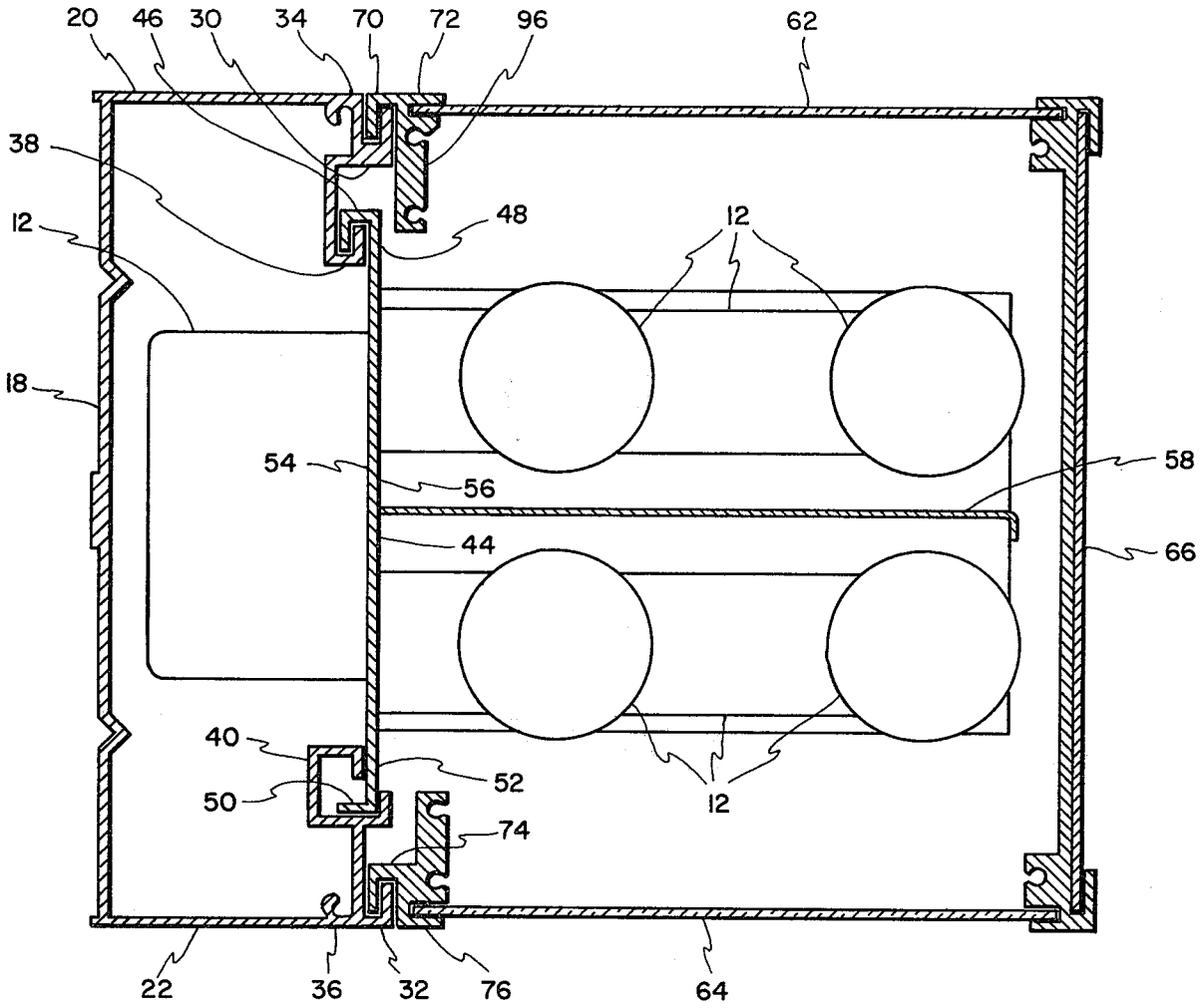
FIG. 2 is a cross-sectional end view of a novel lighting fixture showing the method of attachment of the various parts of the lighting fixture.

As shown more clearly in FIG. 2, the base 14 has outer attachment means comprising a top cover hanger 30 attached to a front end 34 of the top wall 20 and extending over the opening 28 of the base 14, and a bottom cover hanger 32 attached to the front edge 36 of the bottom wall 22 and extending over the opening 28 of the base 14. The base 14 also has inner attachment means comprising a base support section hanger 38 also attached to the front edge 34 of the top wall 20 of the base 14 and extending over the opening 28 of the base 14, and a base support section hinge 40 attached to the front edge 36 of the bottom wall 22 and extending over the opening 28 of the base 14. The top cover hanger 30, the base support section hanger 38, the bottom cover hanger 32, and the base support section hinge 40 all extend horizontally for the entire length of the base 14. In the preferred embodiment the outer attachment means and the inner attachment means are all integrally formed from a single piece of material.

The light fixture 10 also comprises a support section 42 for supporting the electrical lighting components 12. The support section 42 has a wall 44 substantially the size and configuration of the opening 28 of the base 14. The support section 42 also has top and bottom attachment means comprising a top support section hook 46 attached to the top edge 48 of the wall 44 for interlocking with the base support section hanger 38 and a bottom support section hook 50 attached to the bottom edge 52 of the wall 44 for interlocking with the base support section hinge 40. The top support section hook 46 and the bottom support section hook 50 extend horizontally for the entire length of the support section 42. The support section 42 has some of the electrical lighting components 12 mounted on the back surface 54 of the wall 44 thereby residing in the opening 28 of the base 14 when the support section 42 is assembled with the base 14. The support section 42 has other electrical lighting components 12 including lamp brackets for holding at least two lamps on a front surface 56 of the wall 44. The electrical components on the front surface 56 are electrically connected to the electrical components on the back surface 54 of the wall 44. The support section 42 also has a reflective divider 58 positioned between the lamps of the electrical lighting component 12 for directing light in opposite directions. In the preferred embodiment the reflective divider 58 slides in place between the lamps and is removable.

The novel light fixture 10 further includes a box like cover 60 (see FIG. 3) having light emitting portions on top and bottom sides 62 and 64 and a decorative panel on a front side 66 of the cover 60 and two end walls 68. The cover 60 is open on the opposite side from the front side 66 and the cover 60 has substantially the same size configuration as the opening 28 in the base 14. The cover 60 has top and bottom attachment means comprising a top cover hook 70 on the back edge 72 of the top side 62 for interlocking the top cover hanger 30 of the base 14 and a bottom cover hook 74 on the back edge 76 of the bottom side 64 for interlocking with the bottom cover hanger 32 of the base 14. The top cover hook 70 and the bottom cover hook 74 extend horizontally for the entire length of the cover 60.

The light fixture 10 further comprises two end plates 78 (see FIG. 4) for attachment to the end walls 68 of the cover 60. The end plates 78 cover the end walls 68 of the cover 60 and the end walls 24 of the base 14, and also secure the cover 60 and the base 14 together. In the preferred embodiment the securing means is a knurled headed screw 80 suitable for hand tightening which passes through an aperture 82 in the end plate 78 and threads into a threaded hole 84 in the end wall 68 of the cover 60. The end plates 78 have overlapping edges 86, 88 and 90 at the top, bottom and front sides for overlapping the top and bottom walls 20 and 22 of the base 14 and the top, bottom and front sides 62, 64 and 66 of the cover 60.

A means for electrically connecting the electrical component 16 of the base 14 to the electrical lighting components 12 of the support section 42 is provided and comprises a quick disconnect plug and socket 92 and 94. The plug and socket 92 and 94 are of a type which can be connected and disconnected manually without the use of any tools in order that the support section 42 may be easily removed from the base 14. In fact, the entire novel light fixture may be assembled and disassembled without the use of any tools. As shown in FIGS. 1A through 1D, the light fixture is disassembled as follows; the end plates 78 are removed by unscrewing the knurled screws 80, the cover 60 is removed from the base 14 by applying a slight upward movement, disengaging the top and bottom cover hooks 70 and 74 from the top and bottom cover hangers 30 and 32, the support section 42 is disengaged from the base 14 by a similar slight upward movement of the support section 42 and by disconnecting the quick disconnect plug and sockets 92 and 94. The support section 42 may alternately be hinged in a pendant position without disconnecting it from the base 14 allowing accessibility, to the interior and ease of maintenance of the light fixture 10.

Figure 5:
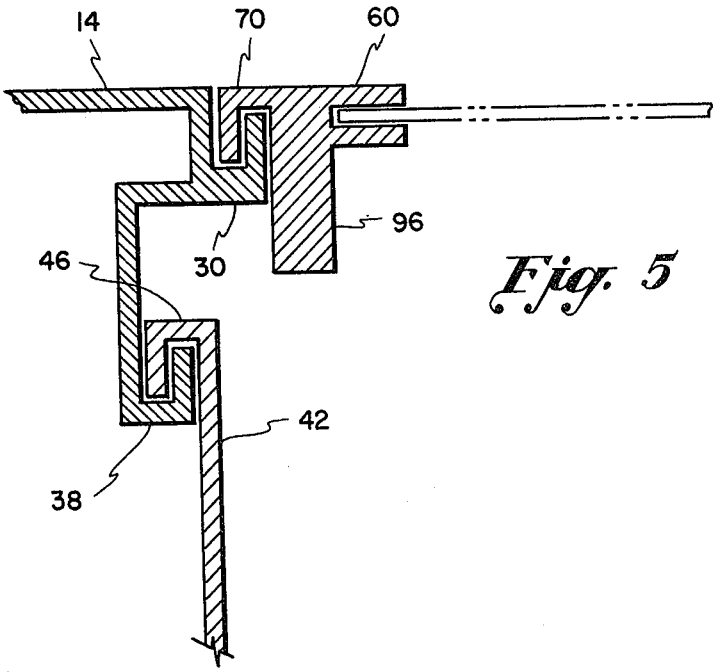
FIG. 5 is a detailed illustration showing the attachment of the various parts of the novel lighting fixture.

The cover 60 also has an internally extending positioning wall 96 as shown in FIG. 5. The positioning wall 96 is located on the edge of the cover 60 near the top cover hook 70 and is spaced a predetermined distance from the top cover hook 70 such that the distance is slightly greater than the thickness of the top cover hanger 30 of the base 14. This insures a better interlocking fit of the top cover hook 70 and the top cover hanger 30.

Figure 6:
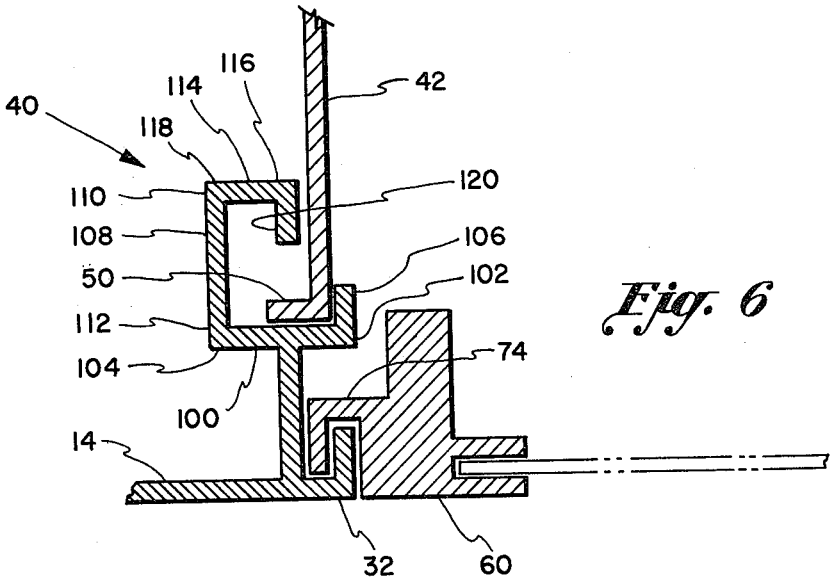
FIGS. 6 and 7 illustrate the two positions which one of the components of the lighting fixture may occupy.
Figure 7:
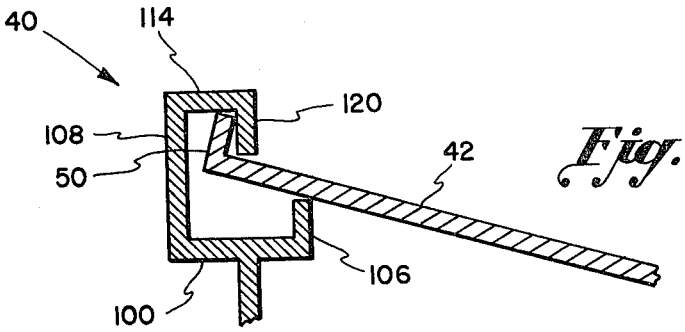

Referring to FIGS. 6 and 7, the base support section hinge 40 and the bottom support section hook 50 will be described in more detail. The base support section hinge 40 comprises a bottom wall 100 having front and rear ends 102 and 104. A verticality 106 is attached to the front end 102 of the bottom wall 100 and extends perpendicularly upward a predetermined distance. A rear wall 108 has top and bottom ends 110 and 112 with the bottom end 112 attached to the rear end 108 of the bottom wall 100. The rear wall 108 extends perpendicularly upward a predetermined distance greater than the predetermined distance of the verticality 106. A top wall 114 has front and rear ends 116 and 118 with the rear end 118 attached to the top end 110 of the rear wall 108. The top wall 114 extends forward towards the verticality 106. A retaining wall 120 is attached to the front end 116 of the top wall 114 and extends perpendicularly downward a predetermined distance toward the bottom wall 100. The retaining wall 120 is positioned inwardly of the verticality 106.

The support section 42 is held in a closed position (as shown in FIG. 6) when the top support section hook 46 is interlocked with the base support section hanger 38 and when the bottom support section hook 50 contacts the bottom wall 100, the inner surface of the verticality 106 and the outer surface of the retaining wall 120 of the base support section hinge 40. The support section 42 is held in a pendant position (as shown in FIG. 7) when the top support section hook 46 is not interlocked with the base support section hanger 38 and when the bottom support section hook 50 contacts the top surface of the verticality 106, the inner surface of the retaining wall 120 and the bottom surface of the top wall 114 of the base support section hinge 40. The pendant position of the support section 42 allows access to the inside of the light fixture 10 without necessarily removing the support section 42 from the base 14.

The top cover hanger 30, the bottom cover hanger 32, the base support section hanger 38 and the base support section hinge 40 of the base 14 are integrally formed from a single piece of material. The top support section hook 46 and the bottom support section hook 50 of the support section 42 are also integrally formed from a single piece of material. In the preferred embodiment aluminum extrusions are used for these pieces.

The invention is not limited to the particular details of the apparatus depicted and other modifications and applications are contemplated. Certain other changes may be made in the above-described apparatus without departing from the true spirit and scope of the invention herein involved. It is intended therefore that the subject matter in the above depiction be interpreted as illustrative and not in a limiting sense.

I claim:

1. A light fixture having electrical lighting components comprising:

a base with electrical components for attachment to a source of electrical power, said base having top and bottom outer attachment means and top and bottom inner attachment means;

where said top and bottom inner attachment means comprise a top support hanger and a bottom support hinge;

a support section for supporting the electrical lighting components haviing top and bottom attachment means for interlocking with said top and bottom inner attachment means of said base;

a cover with light emitting portions having top and bottom attachment means for interlocking with said top and bottom outer attachment means of said base;

means for electrically connecting said electrical components of said base to said electrical lighting components of said support section; and, wherein said support section and said cover can be assembled and disassembled from said base without the use of any tools and also wherein said support section can be held in place on said base in two different positions, said bottom inner attachment means on said base and said bottom attachment means on said support section being capable of interlocking in two different positions.

2. The device described in claim 1 wherein said top and bottom outer attachment means and said top and bottom inner attachment means of said base, and said top and bottom attachment means of said support section and said top and bottom attachment means of said cover all extend horizontally for the entire length of said lighting fixture.

3. The device described in claim 1 wherein said top and bottom outer attachment means and said top and bottom inner attachment means of said base are integrally formed from a single piece of material.

4. A light fixture having electrical lighting components comprising:

a base with electrical components for attachment to a source of electrical power having top and bottom attachment means;

where said top attachment means comprises a base support hanger and the bottom attachment means comprises a base support hinge;

a support section for supporting the electrical lighting components having top and bottom attachment means for interlocking with said top and bottom attachment means of said base;

means for electrically connecting said electrical components of said base to said electrical lighting components of said support section; and, wherein said support section can be assembled and disassembled from said base without the use of any tools and also wherein said support section can be held in place on said base in two different positions, said bottom attachment means on said base and said bottom attachment means on said support section being capable of interlocking in two different positions.

5. The device described in claim 4 wherein said top and botom attachment means of said base, and said top and bottom attachment means of said support section all extend horizontally for the entire length of said lighting fixture.

6. The device described in claim 4 wherein said top and bottom attachment means of said base are integrally formed from a single piece of material and said top and bottom attachment means of said support section are also integrally formed from a single piece of material.

7. A light fixture having electrical lighting components comprising:

a base having a top cover hanger, a bottom cover hanger, a base support section hanger and a base support section hinge;

a support section for supporting the electrical lighting components having a top support section hook for interlocking with said base support section hanger and a bottom support section hook for interlocking with said base support section hinge;

a cover with light emitting portions having a top cover hook for interlocking with said top cover hanger and a bottom cover hook for interlocking with said bottom cover hanger;

means for electrically connecting said electrical components of said base to said electrical components of said support section; and wherein said support section and said cover can be assembled and disassembled from said base without the use of any tools and also wherein said support section can be held in place on said base in two different positions, said base support section hinge cooperating with said bottom support section hook to support said support section in two different positions.

8. The device defined in claim 7 wherein said top cover hanger, said bottom cover hanger, said base support section hanger and said base support section hinge of said base all extend horizontally for the entire length of said base.

9. The device described in claim 7 wherein said top support section hook and said bottom support section hook of said support section both extend horizontally for the entire length of said support section.

10. The device described in claim 7 wherein said top cover hook and said bottom cover hook of said cover both extend horizontally for the entire length of said cover.

11. The device described in claim 7 wherein said base, said support section and said cover all are of substantially equal length.

12. The device defined in claim 7 wherein said top cover hanger, said bottom cover hanger, said base support section hanger and said base support section hinge of said base are integrally formed from a single piece of material and said top support section hook and said bottom support section hook of said support section are also integrally formed from a single piece of material.

13. A light fixture having electrical lighting components comprising:

a substantially rectangular box like base with electrical components for attachment to a source of electrical power, said base having a back wall, top and bottom wall and two end walls, said base also having two internal end support posts each located near an end of said base, said base also having a front opening formed by the box like structure of said base;

a top cover hanger and a base support section hanger attached to a front edge of said top wall and extending over said opening of said base, and a bottom cover hanger and a base support section hinge attached to the front edge of said bottom wall and extending over the opening of said base, said top cover hanger, said base support section hanger, said bottom cover hanger and said base support section hinge extending horizontally for the entire length of said base;

a support section for supporting electrical lighting components having a wall substantially the size and configuration of said opening of said base, said support section also having a top support section hook attached to the top edge of the wall for interlocking with said base support section hanger and a bottom support section hook attached to the bottom edge of said wall for interlocking with said base support section hinge, said top support section hook and said bottom support section hook extending horizontally for the entire length of said support section, said support section having some of the electrical lighting components mounted on a back surface of said wall thereby residing in said opening of said base when said support section is assembled with said base and other electrical lighting components including lamp brackets for holding at least two lamps on a front surface of said wall and electrically connected to said electrical components on said back surface of said wall, said suppoort section also having a reflective divider positioned between said lamps for directing light in opposite directions;

a box like cover having light emitting portions on top and bottom sides of said cover and a decorative panel on a front side of said cover and two end walls, said cover being open on the opposite side from said front side and having substantially the same size and configuration as said opening in said base, said cover also having a top cover hook on the back edge of said top side for interlocking with said top cover hanger of said base and a bottom cover hook on the back edge of said bottom side for interlocking with said bottom cover hanger of said base, said top cover hook and said bottom cover hook extending horizontally for the entire length of said cover;

two end plates for attachment to the end walls of said cover when said cover, said support section and said base are assembled for covering said end walls of said cover and said end walls of said base and also for securing said cover and said base together, said end plates having overlapping edges at said top, bottom and front sides for overlapping said top and bottom sides of said base and said top, bottom and front sides of said cover;

means for electrically connecting said electrical components of said base to said electrical lighting components of said support section; and wherein said support section and said cover can be assembled and disassembled from said base without the use of any tools, and wherein said support section can be held in place on said base in two different positions, said base support section hinge cooperating with said bottom support section hook to support said support section in two different positions.

14. The device described in claim 13 wherein said cover has an internally extending positioning wall on said edge near said top cover hook of said top wall of said cover, said distance between said positioning wall and said end of said top cover hook being slightly greater than the thickness of said top cover hanger of said base.

15. The device described in claim 13 wherein said base support section hinge comprises a bottom wall having a front and rear end, a verticality attached to said front end of said bottom wall and extending perpendicularly upward a predetermined distance, a rear wall having top and bottom ends with the bottom end attached to said rear end of said bottom wall and extending perpendicularly upward a predetermined distance greater than said predetermined distance of said verticality, a top wall having front and rear ends with the rear end attached to said top end of said rear wall and extending forward towards said verticality, and a retaining wall attached to said front end of said top wall and extending perpendicularly downward a predetermined distance toward said bottom wall, wherein said retaining wall is positioned inwardly of said verticality and wherein said support section is held in a closed position when said top support section hook is interlocked with said base support section hanger and said bottom support section hook contacts said bottom wall, the inner surface of said verticality and the outer surface of said retaining wall, and wherein said support section is held in a pendant position when said top support section hook is not interlocked with said base support section hanger and said bottom support section hook contacts the top surface of said verticality, the inner surface of said retaining wall and the bottom surface of said top wall of said base support section hinge.

16. The device defined in claim 13 wherein said top cover hanger, said bottom cover hanger, said base support section hanger and said base support section hinge of said base are integrally formed from a single piece of material and said top support section hook and said bottom support section hook of said support section are also integrally formed from a single piece of material.

* * * * *